United States Patent [19]

Takai

[11] Patent Number: 4,776,259

[45] Date of Patent: Oct. 11, 1988

[54] ROTATION PREVENTING MECHANISM OF WOBBLE PLATE TYPE COMPRESSOR

[75] Inventor: Kazuhiko Takai, Maebashi, Japan

[73] Assignee: Sanden Corporation, Gunma, Japan

[21] Appl. No.: 909,478

[22] Filed: Sep. 19, 1986

[30] Foreign Application Priority Data

Sep. 20, 1985 [JP] Japan ..... 60-142737[U]

[51] Int. Cl.[4] ..... F04B 1/14; F01B 3/02

[52] U.S. Cl. ..... 92/71; 417/269; 74/60

[58] Field of Search ..... 417/269, 270; 92/71, 92/12.2; 91/506; 74/60; 123/58 R, 58 A, 58 AA, 58 B

[56] References Cited

U.S. PATENT DOCUMENTS

| | | | |
|---|---|---|---|
| 2,048,272 | 7/1936 | Linthicum | 74/60 |
| 3,077,118 | 2/1963 | Robbins | 417/269 |
| 3,198,022 | 8/1965 | De Waern | 74/60 |
| 3,528,317 | 9/1970 | Cummins | 74/60 |
| 4,178,136 | 12/1979 | Reid | 417/269 |
| 4,285,640 | 8/1981 | Mukai | 417/269 |
| 4,297,085 | 10/1981 | Brucken | 417/269 |
| 4,418,586 | 12/1983 | Maki | 74/60 |
| 4,433,596 | 2/1984 | Scalzo | 123/58 B |

FOREIGN PATENT DOCUMENTS

| | | | |
|---|---|---|---|
| 515359 | 7/1929 | Fed. Rep. of Germany | 417/269 |

*Primary Examiner*—William L. Freeh

*Attorney, Agent, or Firm*—Banner, Birch, McKie & Beckett

[57] ABSTRACT

A wobble plate type compressor is disclosed wherein each piston is reciprocated within its respective cylinder by a wobble plate driven by a cam rotor mounted on a drive shaft, and in which the wobble plate is held against rotation by a rotation restraining means that includes a slide plate supported within the compressor housing and extending axially thereof, a slot formed in the periphery of the wobble plate and having a pair of concave recesses in the opposed inner surfaces of the slot and a pair of hemispherical bearings seated in the recesses and slidably receiving the slide plate therebetween.

1 Claim, 3 Drawing Sheets

ROTATION PREVENTING MECHANISM OF WOBBLE PLATE TYPE COMPRESSOR

TECHNICAL FIELD

This invention relates generally to a wobble plate type compressor, and more particularly, to a rotation restraining means for the wobble plate in such a compressor.

BACKGROUND OF THE INVENTION

In a known wobble plate type compressor, the rotation of the drive shaft is converted into reciprocating motion by a cam rotor having a sloping end surface that is mounted on a drive shaft and a wobble plate disposed on the sloping end surface with a needle-type thrust bearing therebetween. The wobble plate is restrained against rotation so that upon rotation of the cam rotor, it is caused to wobble.

U.S. Pat. No. 4,073,603 discloses one type of rotation restraining means for a wobble plate of a compressor, that is, a ball member that is mounted on a pin that extends radially outwardly from the wobble plate and is trapped between a pair of opposed track members near the lower portion of compressor housing. In this arrangement, the rotation restraining force acts against the ball and is transferred to the wobble plate through a pin on which the ball is affixed. Because the pin is small relative to the forces involved, the durability of the pin and ball element has suffered. Simply using a larger pin is not suitable because it requires a larger seat in the wobble plate which in turn affects the durability of the wobble plate.

In the U.S. Pat. No. 4,105,370, there is disclosed a modification of the above mentioned rotation restraining means in which the ball element is disposed between and adapted to slide relative to the opposed concave faces of a generally cylindrical guide. In this arrangement, there is line contact between the ball element and the cylindrical guide which causes uneven wear between the ball element and the guide.

Another type of rotation restraining means is shown in FIGS. 1-4 which includes bearing element 1 having a slot 11 at one end that is disposed in a radial bore in the wobble plate 2. A plate 3 mounted in the bottom portion of the crank chamber of the compressor housing is seated in the slot 11 of the bearing element 1 to restrain the wobble plate 2 from rotation.

In this arrangement, the contact between the bearing element 1 and the plate 3 is generally a face contact. However, line contact between the bearing element 1 and plate 3 may occur due to variations in assembly and to stress during operation of the compressor. Abnormal wear and abrasion results when the rotation restraining torque is applied eccentrically against the contact area between the bearing element 1 and the plate 3, thereby causing premature failure.

One resolution of the above mentioned disadvantages is disclosed in U.S. Pat. No. 4,297,085. The guide rod is replaced by the guide plate and the ball element is disposed in a slot in the wobble plate. However, this rotation restraining means has a relatively large number of parts and is relatively complicated in assembly.

SUMMARY OF THE INVENTION

It is a primary object of this invention to provide a wobble plate type compressor with a more durable rotation restraining means.

It is another object of this invention to provide a wobble plate type compressor with a minimum number of parts that can be easily assembled.

It is still another object of this invention to provide a wobble plate type compressor that is relatively low in cost.

A wobble plate compressor according to this invention includes a compressor housing which has a cylinder block provided with a plurality of cylinders and a crank chamber adjacent the cylinder block. A piston is slidably fitted within each of the cylinders and is reciprocated by a wobble plate which is driven by a cam rotor mounted on a drive shaft and held against rotation by a rotation restraining means. A front end plate on the compressor housing includes a bearing for rotatably supporting the drive shaft. A rear end plate is disposed on the opposite end of the compressor housing and has a suction chamber and a discharge chamber. The rotation restraining means for the wobble plate includes a slide plate supported within the compressor housing and extending axially in parallel with the center line of the drive shaft. A slot is formed in the outer surface of the wobble plate and includes a pair of opposed concave recesses in the opposite inner surfaces of the slot. A pair of hemispherical bearing elements are seated in the concave recesses and the slide plate is slidably received between them.

Further objects, features and other aspects of this invention will be understood from the following detailed description of the preferred embodiment of this invention with reference to the annexed drawings.

DETAILED DESCRIPTION

Figure 1:
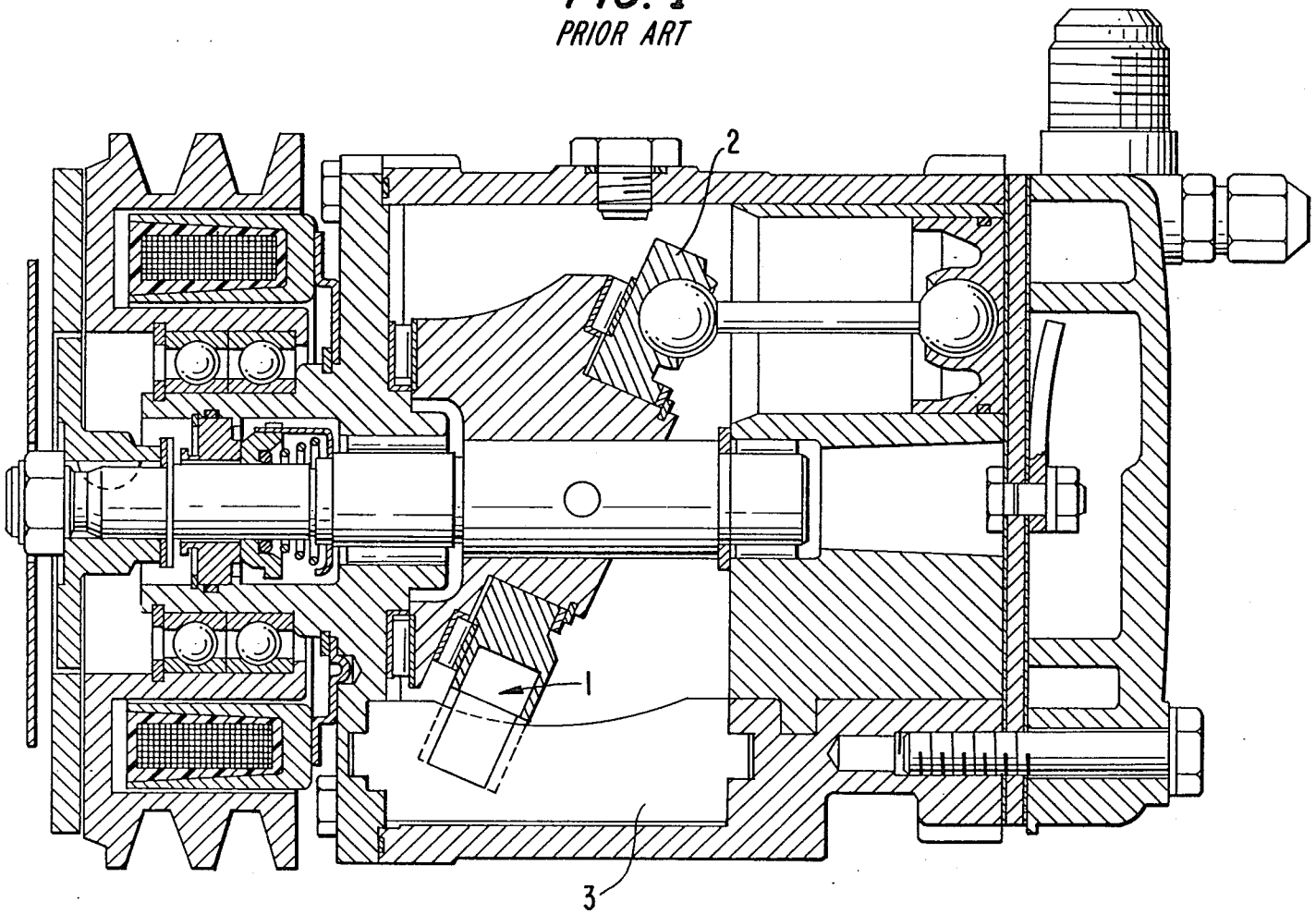
FIG. 1 PRIOR ART
FIG. 1 is a vertical cross-sectional view of a wobble plate type compressor with a conventional rotation restraining means.
Figure 2:
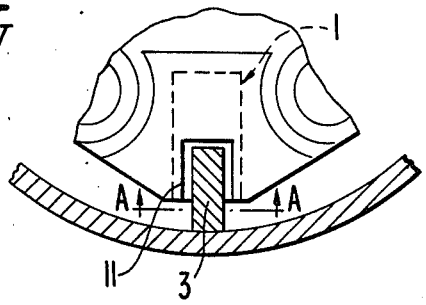
FIG. 2 PRIOR ART
FIG. 2 is a cross-sectional view of the rotation restraining means shown in FIG. 1.
Figure 3:
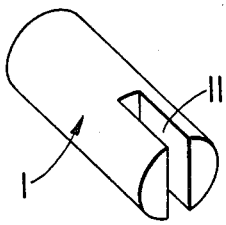
FIG. 3 PRIOR ART
FIG. 3 is a perspective view of a cylindrical bearing element per se of the restraining means of FIG. 1.
Figure 4:
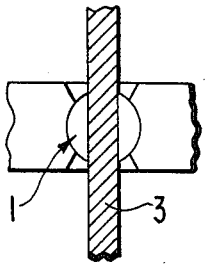
FIG. 4 PRIOR ART
FIG. 4 is a cross-sectional view taken along line A—A of FIG. 2.
Figure 6:
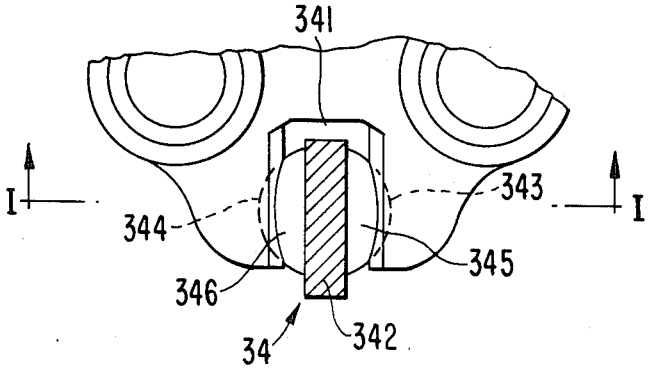
FIG. 6 is a cross-sectional view illustrating the rotation restraining means shown in FIG. 5.
Figure 7:
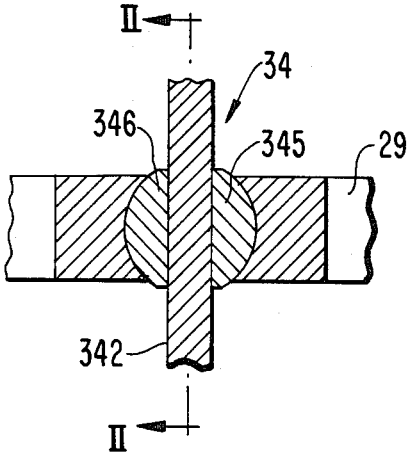
FIG. 7 is a cross-sectional view of a rotation restraining mechanism taken along line I—I of FIG. 6.
Figure 8:
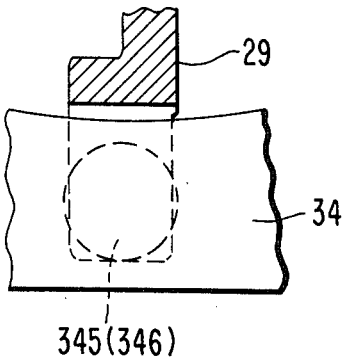
FIG. 8 is a cross-sectional view of a rotation restraining mechanism taken along line II—II of FIG. 7.
Figure 5:
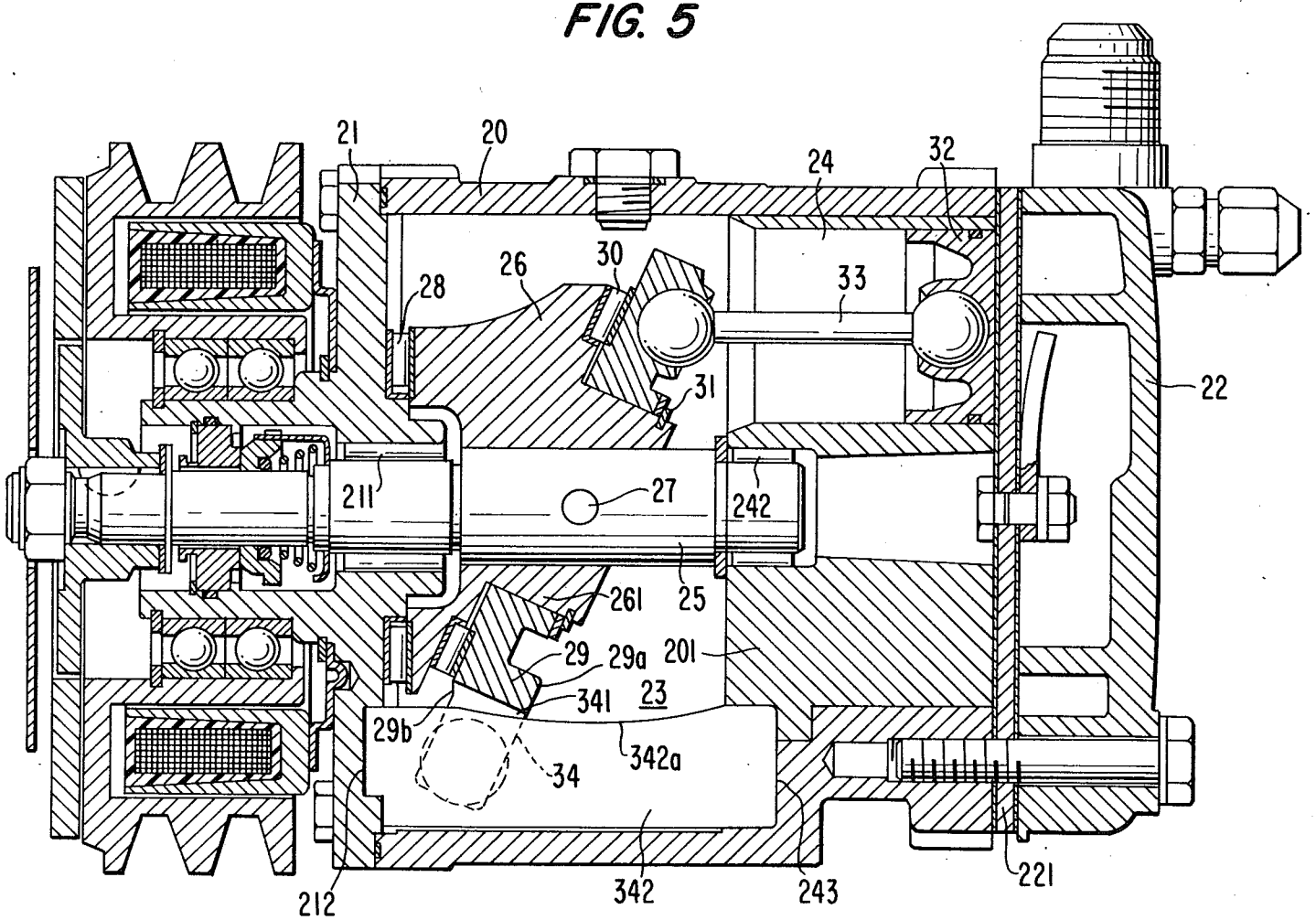
FIG. 5 is a vertical cross-sectional view of the wobble plate type compressor in accordance with this invention.

With reference to FIG. 5, there is shown a wobble plate type compressor comprising a compressor housing 20 having a cylinder block 201 fixed therein at a rear end thereof, and a front end plate 21 disposed on the front end opening of the compressor housing 20. A cylinder head 22 having a discharge chamber and a suction chamber is mounted on the rear end opening of the compressor housing 20 outwardly of a valve plate 221. Compressor housing 20 defines a crank chamber 23 adjacent to the cylinder block 201, and cylinder block 201 is provided with a plurality of equiangularly spaced cylinders 24. A drive shaft 25 is rotatably supported at the rear end in the block 201 through a bearing 242 and at the front end in the plate 21 through bearing 211. A cam rotor 26 is fixedly mounted on the drive shaft 25 by a pin 27 and rotatably supported relative to the inner surface of the front end plate 21 through a thrust bearing 28. Wobble plate 29 is disposed on a reduced diameter portion 261 of the cam rotor 26 that extends axially outwardly from the inclided cam surface of the cam rotor 26 and there is a thrust bearing 30 interposed between the wobble plate and inclined cam surface of the cam rotor 26.

Wobble plate 29 is prevented from axial movement on the reduced diameter portion by a restraining ring 31. A piston 32 is reciprocably received in each of the cylinders 24 and connected to the wobble plate 29 through a piston rod 33.

Referring to FIGS. 5, 6, 7 and 8, the rotation restraining means 34 includes a slot 341 formed in the peripheral surface of the wobble plate 29 and a slide plate 342 mounted in the bottom portion of the crank chamber 23 and extending axially thereof.

Slot 341 extends from the front edge 29*a* to the rear edge 29*b* of the wobble plate 29 and is provided with concave recesses 343, 344 in the opposed inner surfaces of the slot 341. Hemispherical bearings 345, 346 are seated in the recesses 343, 344, respectively, and are dimensioned to provide a gap between them that is a little larger than the thickness of the slide plate 342. Slide plate 342 extends axially of the compressor housing 20 and is supported by the front end plate 21 and housing 20. The inner edge 342a of the slide plate 342 is depressed to provide clearance for the wobble plate 29 during operation and the slide plate 342 is long enough to accommodate the complete range of motion of the wobble plate 29. The spherical surfaces of the hemispherical bearings 345, 346 are seated in the recesses 343, 344 for universal motion and the flat faces thereof slidably engage the opposite faces of the slide plate 342.

In the above-mentioned compressor, when driving force is transmitted from an external driving source to the drive shaft 25, cam rotor 26 is rotated together with drive shaft 25. The wobble plate 29 is held against rotation with the cam rotor 26 by the rotation restraining means 34, but is free to slide relative to the slide plate 342 with the hemispherical bearings 345, 346 of wobble plate 29 engaging the opposite surfaces of slide plate 342. Therefore, the pistons 32 are reciprocated within the cylinder 24 in accordance with the motion of wobble plate 29.

In this construction of the rotation restraining means, the contact between the hemispherical bearings and the slide plate is a surface contact, because, even if the elements are not properly aligned due to assembly error, the hemispherical bearings are free to self-adjust to the slide plate. Therefore, abnormal wear of the rotation restraining means is prevented and the durability of the compressor is thus improved.

This invention has been described in detail in connection with a preferred embodiment, but this is for illustration only and this invention is not restricted thereto. It will be understood by those skilled in the art that variations and modifications can be made without departing from the scope of this invention.

I claim:

1. In a wobble plate type compressor comprising a compressor housing including a cylinder block having a plurality of spaced cylinders, a plurality of pistons slidably fitted into respective ones of said cylinders, a drive shaft, a cam rotor mounted on said drive shaft and having an inclined cam surface, a wobble plate cooperating with said inclined cam surface, rotation restraining means coupled to said wobble plate for restraining said wobble plate against rotation, and piston rods connecting respective ones of said pistons to said wobble plate, said rotation restraining means comprising a slide plate supported within said compressor housing and extending axially thereof, a slot in the peripheral surface of said wobble plate, concave recesses in the opposed inner surfaces of said slot and a pair of hemispherical bearings seated in said recesses, said slide plate disposed between the flat surfaces of said hemispherical bearings such that, during the range of motion of said wobble plate, said hemispherical bearings continuously correct for any nonuniformity of the nutating motion of said wobble plate.

* * * * *